US008528355B2

(12) United States Patent
Bortoletto et al.

(10) Patent No.: US 8,528,355 B2
(45) Date of Patent: Sep. 10, 2013

(54) ATOMIZATION UNIT WITH NEGATIVE PRESSURE ACTUATOR

(75) Inventors: Anderson Bortoletto, Waunakee, WI (US); Rameet Singh Grewal, Pune (IN); Guolian Wu, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 791 days.

(21) Appl. No.: 12/730,322

(22) Filed: Mar. 24, 2010

(65) Prior Publication Data

US 2011/0233300 A1 Sep. 29, 2011

(51) Int. Cl.
*F25D 23/06* (2006.01)

(52) U.S. Cl.
USPC ..... 62/274

(58) Field of Classification Search
USPC ..... 62/91, 126, 158, 274; 239/101
See application file for complete search history.

(56) References Cited

U.S. PATENT DOCUMENTS

| | | | | |
|---|---|---|---|---|
| 3,490,697 | A | 1/1970 | Best, Jr. | |
| 4,085,893 | A | 4/1978 | Durley, III | |
| 4,488,816 | A | 12/1984 | Vota | |
| 4,642,581 | A | 2/1987 | Erickson | |
| 5,403,587 | A | 4/1995 | McCue et al. | |
| 5,687,905 | A * | 11/1997 | Tsai | 239/4 |
| 5,703,552 | A | 12/1997 | Buffet et al. | |
| 6,436,342 | B1 | 8/2002 | Petri et al. | |
| 6,530,370 | B1 | 3/2003 | Heinonen | |
| 6,669,103 | B2 | 12/2003 | Tsai | |
| 6,751,520 | B2 | 6/2004 | Mathewes et al. | |
| 6,769,626 | B1 | 8/2004 | Haveri | |
| 6,837,445 | B1 | 1/2005 | Tsai | |
| 7,225,807 | B2 | 6/2007 | Papania et al. | |
| 7,483,767 | B2 | 1/2009 | Montaser et al. | |
| 7,538,473 | B2 | 5/2009 | Blandino et al. | |
| 2002/0033173 | A1 * | 3/2002 | Shofner et al. | 128/200.22 |
| 2007/0152081 | A1 | 7/2007 | Chou et al. | |
| 2008/0290189 | A1 | 11/2008 | Levi | |

FOREIGN PATENT DOCUMENTS

| | | | |
|---|---|---|---|
| JP | 2009002590 | A | 1/2009 |
| WO | 02/36269 | A1 | 5/2002 |
| WO | 2006/037823 | A1 | 4/2006 |
| WO | 2006/121791 | A1 | 11/2006 |

* cited by examiner

*Primary Examiner* — Melvin Jones
(74) *Attorney, Agent, or Firm* — Kirk W. Goodwin

(57) ABSTRACT

An atomization unit is described that employs a negative pressure actuator to reduce the fluid pressure acting on the atomizer in order to minimize or prevent fluid leakage from the atomizer. Methods of minimizing or preventing fluid leakage from an atomizer through use of a negative pressure actuator are also described. The atomization unit is particularly suitable for use in a refrigerator to cool and humidify at least a portion of the refrigerator.

20 Claims, 2 Drawing Sheets

ATOMIZATION UNIT WITH NEGATIVE PRESSURE ACTUATOR

FIELD OF THE INVENTION

The presently described technology relates generally to an atomization unit for atomizing a liquid wherein the liquid is atomized through a perforated layer. More specifically, the presently described technology relates to an atomization unit that employs a negative pressure actuator to reduce the fluid pressure acting on the perforated layer to thereby minimize or prevent leakage of the fluid through the perforated layer. The atomization unit is particularly suited for use in a refrigerator to cool and humidify at least a portion of the refrigerator.

BRIEF SUMMARY OF THE INVENTION

One aspect of the presently described technology is to provide an atomization unit having a negative pressure actuator that reduces the fluid head pressure acting on the atomizer in order to minimize fluid leakage. The atomization unit comprises a liquid storage unit containing a liquid to be atomized; an atomizer in fluid communication with the liquid contained within the liquid storage unit and comprising a perforated layer through which the liquid is atomized. The atomizer is positioned such that the liquid contained within the storage unit is maintained above the atomizer resulting in a positive fluid pressure acting on the atomizer. The atomization unit further comprises an actuator in sealing relation with the liquid storage unit, wherein when the actuator is activated, the actuator promotes a negative fluid pressure that reduces the fluid pressure acting on the atomizer, thereby minimizing leakage of fluid through the perforated layer.

Another aspect of the presently described technology is to provide a method of minimizing liquid leakage through a perforated layer of an atomizer subjected to a positive liquid head pressure. The method of the presently described technology comprises the steps of:

(a) providing a liquid storage unit containing a liquid to be atomized, the liquid storage unit further comprising an actuator in sealing relation with the liquid storage unit;

(b) providing an atomizer in fluid communication with the liquid contained within the liquid storage unit, the atomizer comprising a perforated layer and positioned within the liquid storage unit such that a column of liquid is maintained above *the atomizer resulting in a positive fluid pressure acting on the atomizer; and (c) reducing the fluid pressure acting on the atomizer by moving the actuator in a direction that promotes a negative fluid pressure, wherein reduction in the fluid pressure minimizes liquid leakage through the perforated layer.

The atomization unit described herein is particularly suitable for use in a refrigerator to cool and humidify at least a portion of the refrigerator. It is therefore a further aspect of the presently described technology to provide an atomization unit for a refrigerator for cooling and humidifying at least a portion of the refrigerator, wherein the atomization unit comprises a negative pressure actuator that promotes a negative fluid pressure that reduces the fluid pressure acting on the atomizer, to thereby minimize leakage of fluid through the perforated layer of the atomizer.

Figure 1:
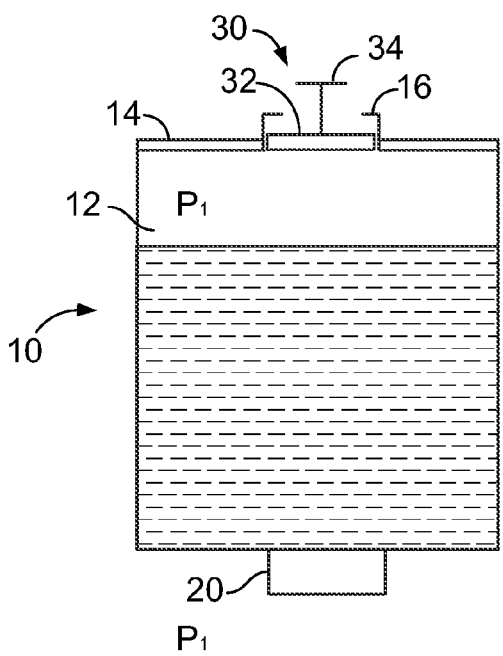
FIG. 1 is a diagrammatical representation of an atomization unit showing the negative pressure actuator in an unactivated position.

The foregoing summary, as well as the following detailed description of certain embodiments of the presently described technology, will be better understood when read in conjunction wit the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

The present technology relates to an atomization unit that employs a negative pressure actuator to reduce the fluid pressure acting on the atomizer in order to minimize or prevent leakage of fluid from the atomizer. Methods of minimizing or preventing fluid leakage from an atomizer are also described.

Piezoelectric atomizers can be found in a wide variety of applications, such as domestic humidifiers, aroma dispensers, and medical nebulizers. Piezoelectric atomization technology relies on vibrations created by a piezoelectric cell when an AC power with a low ultrasonic frequency (around 0.01 to 2 MHz) is applied. Fluid passes over the vibrating surface and the vibration energy causes the fluid to break into droplets.

In the presently described technology, low wattage ultrasonic water atomizers are enabled by the use of annular piezo elements mounted on a perforated nickel diaphragm. In this way, water can be made available at the external surface of the diaphragm where atomization takes place. One feature of a low wattage ultrasonic atomizer is the ability to change mist direction. However, in certain orientations, pressure promoted by a water column acting on the piezo element can lead to a siphoning effect through the diaphragm perforations. This siphoning effect can lead to water leaks that can delay the start up of the atomizer feature. The atomizer has two operation states—"misting" and "off." Each of these operation states has a different water head limit. After the atomizer mists for a few minutes and then stops, water drops seep through the perforations in the diaphragm. Also the atomizer takes some time to absorb the water drops and start misting again. In the "misting" operation state, the water head limit is about three inches. Therefore, a water column of about three inches acting on the piezo element can lead to water leaks through the perforations in the diaphragm.

Another consideration for the atomizer is the need to continuously maintain a water layer on top of the piezo cell in order for it to mist. Also, fluid flow to the piezo cell needs to be maintained for proper functioning of the piezo cell. Because the water column above the piezo cell cannot exceed three inches, due to the possibility of water leakage, maintaining a constant water availability can result in frequent refillings and/or monitoring, which can be inconvenient. It would, therefore, be desirable to provide an atomization unit that can minimize or prevent leakage through a perforated diaphragm or layer, even in the presence of a water column that is three inches or greater.

Figure 2:
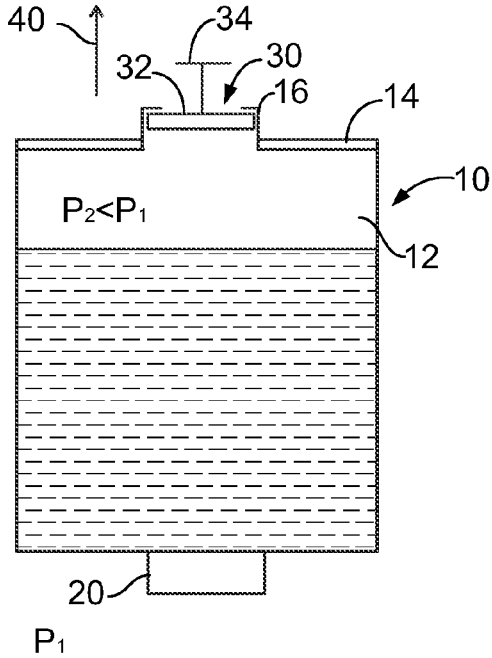
FIG. 2 is a diagrammatical representation of an atomization unit showing the negative pressure actuator in an activated position.

Referring generally to FIGS. 1 and 2, an atomization unit 10 of the presently described technology is shown. The atomization unit 10 includes a storage unit or tank 12 adapted for storing the liquid to be atomized. Typically, the liquid will be water, but other liquids are also contemplated. The storage tank should be constructed to be water tight, especially around its sides and bottom to prevent leakage.

The storage tank 12 can be of various sizes and shapes depending upon the end use for the atomization unit. The storage tank 12 is sized and shaped to accommodate a water column above the atomizer that is at least three inches in height. A storage tank of such a size will provide a sufficient liquid supply to the atomizer to maintain proper functioning of the atomizer without the need for frequent refillings that would be required with smaller storage tanks. In one embodiment, the storage tank 12 includes a removable tank cover 14 to allow convenient filling of the storage tank. Optionally, the tank cover 14 can be provided with a cap 16.

The atomization unit 10 includes an atomizer 20 in fluid communication with the storage tank 12. Typically, the atomizer 20 is located at the bottom of the storage tank and liquid flows to the atomizer through an opening (not shown) in the base of the storage tank. The atomizer 20 is positioned relative to the storage tank 10 such that the liquid in the storage tank promotes a fluid head pressure acting on the atomizer.

The atomizer 20 comprises a piezo cell that includes a perforated diaphragm or layer that vibrates when stimulated whereby fluid from a top surface of the piezo cell is drawn through the perforations and distributed in an atomized spray from a bottom surface of the piezo cell. The diaphragm is a perforated diaphragm with perforations that are about 8 to about 12 microns. One side of the diaphragm is in contact with the liquid in the storage tank, while the other side of the diaphragm is exposed to the atmosphere. The piezo cell is fitted within an enclosed casing, and top and bottom seals on either side of the piezo cell allow vibration but maintain a water-tight seal between the piezo cell and the casing. The sealing force of the seals on the piezo cell should not exceed 0.145 pounds.

The atomizer is a low wattage atomizer and operation of the atomizer requires electrical input of 110 kHz, up to 200 mA at 5 volts.

The atomization unit 10 includes a negative pressure actuator which functions to reduce the fluid head pressure acting on the atomizer to thereby minimize or prevent liquid from leaking through the perforations in the atomizer diaphragm. The negative pressure actuator comprises a sealable member that forms a seal with an opening in the storage tank and is movable relative to the storage tank. Typically, the negative pressure actuator is mounted to the storage tank lid and seals an opening in the lid. However, the negative pressure actuator can be mounted to a sidewall of the storage tank, provided that the negative pressure actuator is mounted at a position that is above the level of the liquid in the storage tank.

The sealable member of the negative pressure actuator can take a variety of forms as long as it forms a seal with the storage tank and is moveable relative thereto. For example, the sealable member can be a disk similar to a suction cup, or a moveable plug. The sealable member is preferably formed from rubber, silicone or an elastomeric material.

In one embodiment, illustrated in FIGS. 1 and 2, the negative pressure actuator is a piston 30 that has a sealable head 32 and a stem 34 connected to the piston. The piston 30 is moveable within the cap 16 located on the cover 14 of the storage tank 12 and forms a seal with the cap 16. As shown in FIG. 1, in its unactivated position, the sealable head 32 is at the same level as the storage tank cover 14. In this position, the fluid head pressure acting on the liquid in the storage tank 12 is equivalent to the ambient air pressure and the atomizer 20 is subject to leakage.

The piston 30 is activated by moving the piston stem 34 in a direction away from the storage tank 12, which, in the FIG. 2 embodiment is in the upward direction indicated by the arrow 40. Activation of the piston 30 creates a vacuum or negative pressure effect that reduces the fluid pressure acting on the atomizer 20 to less than atmospheric pressure. Reduction in the fluid pressure minimizes or prevents leakage of the fluid through the perforations in the diaphragm.

Method of Operation

To operate the atomization unit 10, the storage tank 12 is filled with liquid to a desired level, leaving at least some head room between the liquid level and the tank cover 14, and the tank cover 14 is closed. The filled storage tank 12 results in a positive fluid pressure acting on the atomizer 20 located at the base of the storage tank. After the storage tank 12 is filled, the negative pressure actuator is activated by moving the actuator in a direction that promotes a negative fluid pressure. In the embodiment shown in FIGS. 1 and 2, the negative pressure actuator is a piston that is moved upwardly in the direction of the arrow 40 to create a negative pressure acting on the liquid in the storage tank. Once the negative pressure actuator is activated, the atomizer is turned on to begin the misting cycle. Because the negative pressure actuator acts to reduce the fluid pressure acting on the atomizer, liquid leakage through the perforated diaphragm is minimized or prevented.

Uses for the Atomization Unit

Figure 3:
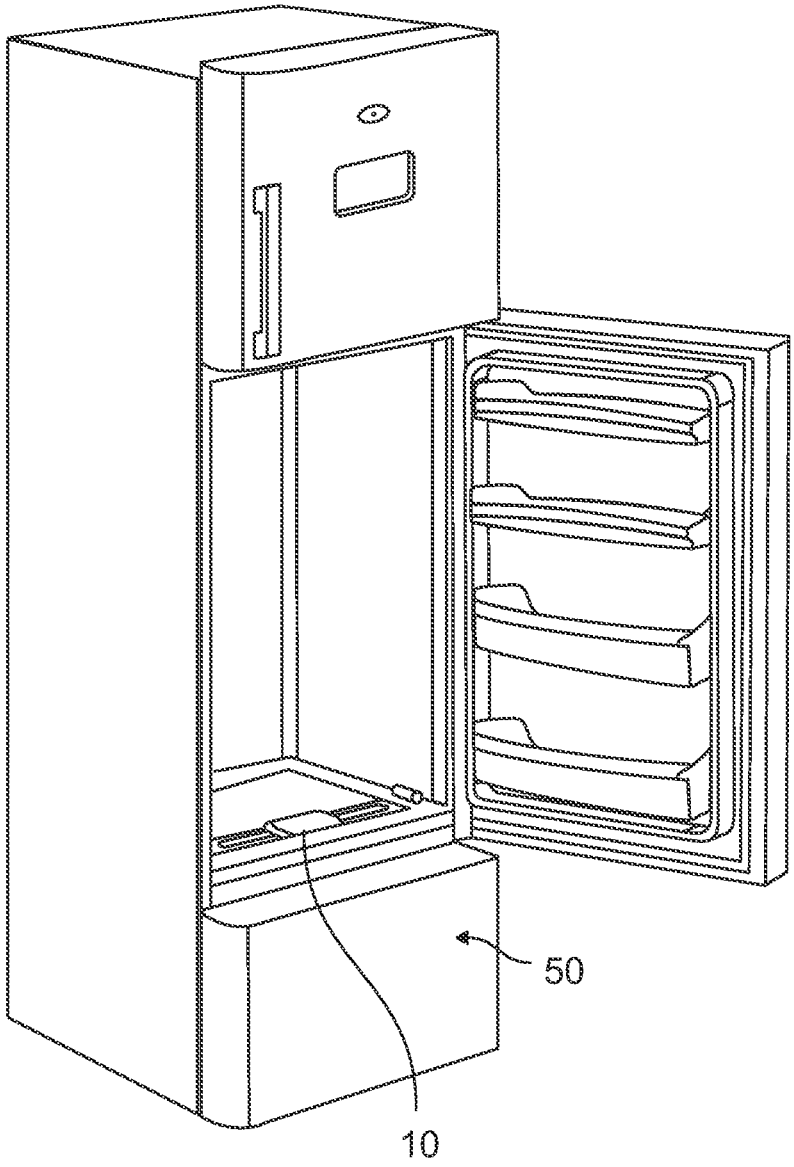
FIG. 3 illustrates a refrigerator provided with an atomization unit of the present technology.

The atomization unit 10 employing a negative pressure actuator as described herein can be used in a variety of applications that employ atomizers subjected to a positive fluid head pressure. One useful application is in a refrigerator that utilizes an atomization unit to cool and humidify a compartment of the refrigerator. For example, an atomization unit 10 as described herein is particularly useful for applying atomized liquid to fruits and vegetables stored within the crisper compartment of a refrigerator. Illustrated in FIG. 3 is one embodiment of a refrigerator 50 showing the atomization unit 10 of the presently described technology installed to provide atomized liquid to the crisper compartment of the refrigerator 50. Preferably, the atomization unit 10 is a modular design that is configured and adapted to be added to or removed from a refrigerator as a unit.

The invention is now described in such full, clear, concise and exact terms as to enable any person skilled in the art to which it pertains, to practice the same. It is to be understood that the foregoing describes preferred embodiments of the invention and that modifications may be made therein without departing from the spirit or scope of the invention as set forth in the appended claims.

What is claimed is:

1. An atomization unit comprising:

a liquid storage unit containing a liquid to be atomized;

an atomizer in fluid communication with the liquid contained within the liquid storage unit and positioned such that an amount of the liquid is maintained above the atomizer resulting in a positive fluid pressure acting on the atomizer, the atomizer comprising a perforated layer through which the liquid is atomized; and a negative pressure actuator in sealing relation with the liquid storage unit, wherein when the actuator is activated, the actuator promotes a negative fluid pressure that reduces the fluid pressure acting on the atomizer, thereby minimizing leakage of fluid through the perforated layer.

2. The atomization unit of claim 1, wherein the actuator comprises a sealable member that forms a seal with the liquid storage unit.

3. The atomization unit of claim 2, wherein the sealable member is formed from rubber, silicone or an elastomeric material.

4. The atomization unit of claim 2, wherein the sealable member is on a piston that is movable within the liquid storage unit.

5. The atomization unit of claim 4, wherein the piston is activated by moving the piston in a direction away from the liquid storage unit.

6. The atomization unit of claim 5, wherein the liquid storage unit comprises a cap, and the sealable member of the piston forms a seal with the cap.

7. The atomization unit of claim 1, wherein when the actuator is activated, the fluid pressure acting on the atomizer is less than atmospheric pressure.

8. The atomization unit of claim 1, wherein the liquid above the atomizer is a liquid column at least three inches in height.

9. A method of minimizing liquid leakage through a perforated layer of an atomizer subjected to a positive liquid head pressure, the method comprising the steps of:

(a) providing a liquid storage unit containing a liquid to be atomized, the liquid storage unit further comprising an actuator in sealing relation with the liquid storage unit;

(b) providing an atomizer in fluid communication with the liquid contained within the liquid storage unit, the atomizer comprising a perforated layer and positioned within the liquid storage unit such that a column of liquid is maintained above the atomizer resulting in a positive fluid pressure acting on the atomizer; and (c) reducing the fluid pressure acting on the atomizer by moving the actuator in a direction that promotes a negative fluid pressure, wherein reduction in the fluid pressure minimizes liquid leakage through the perforated layer.

10. The method of claim 9, wherein the actuator comprises a sealable member that forms a seal with the liquid storage unit.

11. The method of claim 10, wherein the sealable member is on a piston that is movable within the liquid storage unit.

12. The method of claim 11, wherein the piston is moved in a direction away from the liquid storage unit.

13. The method of claim 9, wherein the column of liquid above the atomizer is at least three inches in height.

14. The method of claim 9, wherein movement of the actuator reduces the fluid pressure acting on the atomizer to less than atmospheric pressure.

15. An atomization unit for a refrigerator for cooling and humidifying at least a portion of the refrigerator, the atomization unit comprising:

a liquid storage unit containing a liquid to be atomized to at least a portion of the refrigerator;

an atomizer in fluid communication with the liquid contained within the liquid storage unit and positioned such that an amount of the liquid is maintained above the atomizer resulting in a positive fluid pressure acting on the atomizer, the atomizer comprising a perforated layer through which the liquid is atomized into at least a portion of the refrigerator; and an actuator in sealing relation with the liquid storage unit, wherein when the actuator is activated, the actuator promotes a negative fluid pressure that reduces the fluid pressure acting on the atomizer, thereby minimizing leakage of fluid through the perforated layer.

16. The atomization unit of claim 15, wherein the actuator comprises a sealable member that forms a seal with the liquid storage unit.

17. The atomization unit of claim 16, wherein the sealable member is on a piston that is movable within the liquid storage unit.

18. The atomization unit of claim 17, wherein the liquid storage unit comprises a cap, and the sealable member of the piston forms a seal with the cap.

19. The atomization unit of claim 15, wherein when the actuator is activated, the fluid pressure acting on the atomizer is less than atmospheric pressure.

20. The atomization unit of claim 15, wherein the liquid above the atomizer is a liquid column at least three inches in height.

* * * * *